United States Patent [19]

Scott et al.

[11] Patent Number: 4,562,929

[45] Date of Patent: Jan. 7, 1986

[54] BACKSTOP ASSEMBLY FOR USE WITH CUSHIONING DEVICE IN SILL OF RAILWAY CAR

[75] Inventors: Mark P. Scott, Boiling Springs; Steve A. Brough, Camp Hill, both of Pa.

[73] Assignee: Keystone Industries, Inc., Rolling Meadows, Ill.

[21] Appl. No.: 481,341

[22] Filed: Apr. 1, 1983

[51] Int. Cl.[4] ..... B61G 9/16

[52] U.S. Cl. ..... 213/20; 213/7; 213/43

[58] Field of Search ..... 213/7, 43, 19, 20, 74, 213/50, 50.5, 12; 188/282, 284

[56] References Cited

U.S. PATENT DOCUMENTS

| | | |
|---|---|---|
| 1,858,730 | 8/1932 | Duryea . |
| 2,129,543 | 2/1938 | Duryea . |
| 2,129,545 | 9/1938 | Duryea . |
| 2,129,548 | 11/1938 | Duryea . |
| 3,166,200 | 1/1965 | Danielson . |
| 3,589,527 | 6/1971 | Seay . |
| 3,589,528 | 6/1971 | Stephenson . |
| 3,622,015 | 11/1971 | Atkinson . |
| 3,791,534 | 2/1974 | Stephenson . |
| 3,854,596 | 12/1974 | Stephenson et al. . |
| 3,917,075 | 11/1975 | Knippel . |
| 4,040,523 | 8/1977 | Carle et al. . |
| 4,113,113 | 9/1978 | Reinhardt et al. . |
| 4,261,471 | 4/1981 | Reinhardt et al. . |

OTHER PUBLICATIONS

Freight Master End of Car Hydraulic Cushioning Device, printed USA, 6/1964.

*Primary Examiner*—Robert B. Reeves
*Assistant Examiner*—Dennis C. Rodgers
*Attorney, Agent, or Firm*—Leydig, Voit & Mayer, Ltd.

[57] ABSTRACT

A backstop assembly for use with a cushioning device in the sill of a railway car. The cushioning device has a body, or cylinder, slidable endwise in the sill and carrying a car coupler at its outer end. The cylinder has a piston centered on the sill axis and a piston rod projecting from its inner end terminating in an enlarged end collar of circular cross section which is received in a backstop. The backstop is of rectangular box shape secured in the sill and having an inner end wall, outer end wall, top wall and parallel side walls, the end walls being axially spaced to form a chamber for loose, axially captive accommodation of the collar. The outer end wall has an arch-shaped clearance opening for loose accommodation of the piston rod. A thin rectangular locator plate is provided in the chamber having a circular opening for snug accommodation of the collar, the plate being secured at its lower edge to a bridge member which spans, and is secured to, the walls of the sill for maintaining the plate in a transaxial position in the chamber with the circular opening precisely centered on the sill axis. Thus upon impact the piston rod engages the inner wall of the backstop in a position precisely aligned with the sill axis where it is frictionally maintained during buildup of compressive reaction force in the cushioning device thereby to insure that the force in the rod is purely axial.

2 Claims, 7 Drawing Figures

BACKSTOP ASSEMBLY FOR USE WITH CUSHIONING DEVICE IN SILL OF RAILWAY CAR

BACKGROUND OF THE INVENTION

It is conventional in the construction of railroad freight cars to provide, under the floor of the car and along the centerline, a "sill" of inverted U-shaped cross section. At each end of the sill there is a cushioning device having a body or cylinder, to which is connected a car coupler and including a piston rod which extends inwardly along the sill axis, the end of the piston rod having an enlarged end collar which is held axially captive, against movement in either direction, in a box-like "backstop" of durable construction which is seated in the sill and welded or otherwise anchored to the walls of the sill.

A piston within the body of the cushioning device normally occupies a centered position, with hydraulic fluid on both sides, the piston having an orifice which develops back pressure when a shock is applied to the coupler on the cushioning device in either "buff" or "draft" direction thereby to secure cushioning action analogous to that provided in an automotive shock absorber. Since the construction described above is used almost universally in the railroad industry, efforts have been made in the design and installation to insure long life in the face of hard field usage. Thus the cushioning devices on the market are carefully manufactured using high quality steel and durable seals and piston rods of heavy cross section. Theoretically the devices should last almost indefinitely and should be able to withstand even the highest shock forces which may be encountered in practice. In actuality, however, the devices have a relatively short life, with breakage of the piston rod a frequent cause for replacement. The reason for breakage of a conservatively designed piston rod has been something of a mystery. Questions have also been raised as to the reason for premature degradation and failure of the fluid seals. Leakage at the seals is particularly troublesome in the case of so-called "gas returned" cushioning devices where a high pressure charge of compressed gas is relied upon, in lieu of a spring, for stroking the piston to centered position.

SUMMARY OF THE INVENTION

It is, accordingly, an object of the present invention to provide a backstop assembly for a cushioning device in the sill of a railway car which has the effect of greatly increasing the useful life of the cushioning device, virtually preventing catastrophic rod breakage and substantially reducing the likelihood of leakage in the field even in the face of extended hard usage.

It is another object of the present invention to provide a device of the class described in which the benefit of extended life has been provided without necessity for modifying the design of the cushioning device itself and while utilizing a backstop construction of a type which is in almost universal usage. In other words, it is an object of the invention to provide a cushioning installation in the sill of a railway car which, for the most part, employs known elements available at a low competitive cost but which, with the addition of an auxiliary member costing only a few pennies enables the life of both the cushioning assembly and the backstop to be extended, with substantial freedom from catastrophic failure.

It is a related object to provide an improved cushioning assembly which is as readily installed and removed as an assembly of conventional construction, involving the use of a single added piece simply held in working position by a pair of threaded machine screws.

Other objects and advantages of the invention will become apparent upon reading the attached detailed description and upon reference to the drawings in which:

While the invention has been described in connection with a preferred embodiment, it will be understood that there is no intention to limit the invention to the particular embodiment shown but it is intended, on the contrary, to cover the various alternative and equivalent forms of the invention included within the spirit and scope of the appended claims.

DESCRIPTION OF THE PREFERRED EMBODIMENT

Figure 1:
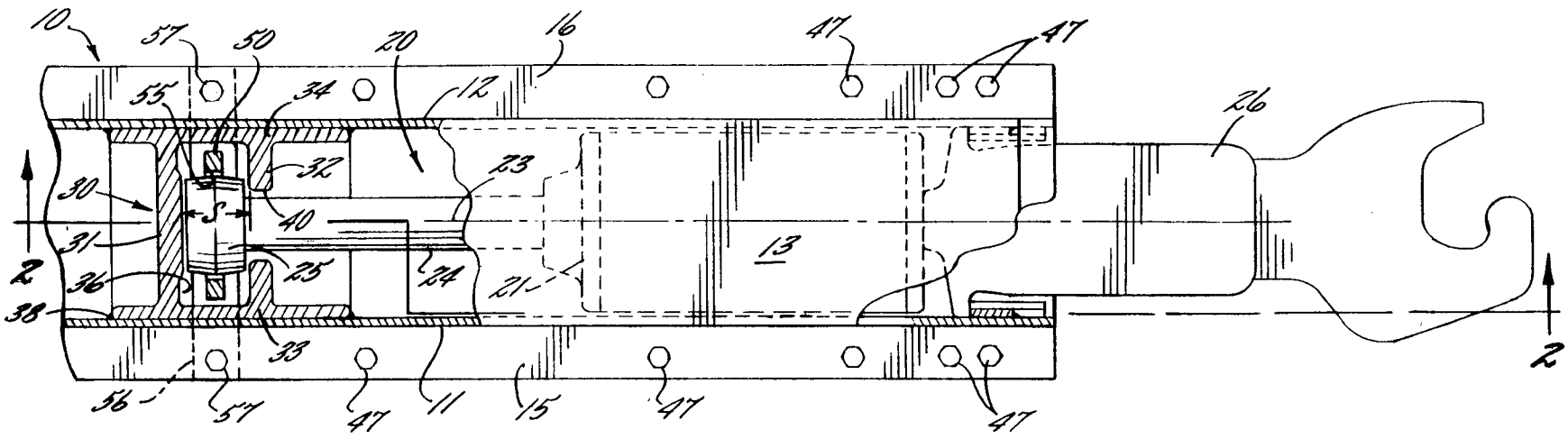
FIG. 1 is a plan view, in partial section, of a sill including a cushioning device and backstop assembly constructed in accordance with the invention.
Figure 2:
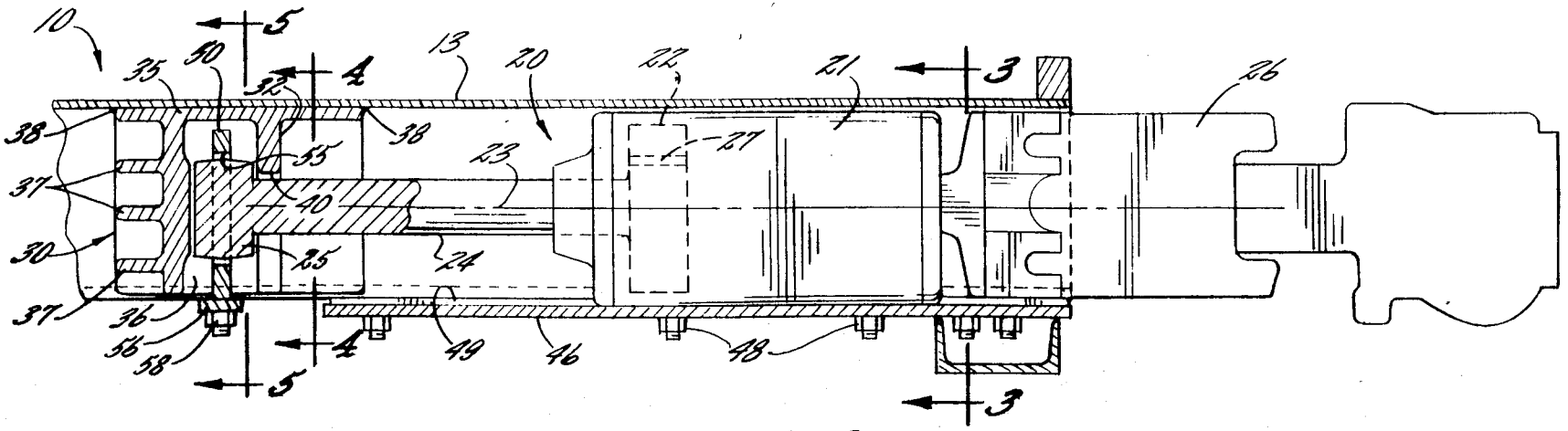
FIG. 2 is an elevational view, also in partial section, looking along line 2—2 in FIG. 1.

Turning now to FIGS. 1 and 2 of the drawings, there is shown the end portion of a sill 10 which extends longitudinally below the floor of a railroad car, particularly a freight car. The sill, made of heavy metal, is of inverted U-shaped cross section having parallel side walls 11, 12 and a top wall 13. The side walls are terminated in outwardly extending flanges 15, 16, respectively.

Mounted at the end of the sill is a cushioning device 20 having a body or cylinder 21 of rectangular cross section which is fitted, for endwise sliding movement, in the sill and which contains a piston 22 having a centerline which is centered along the sill axis 23. Connected to the piston 22 is a piston rod 24 having the usual seals (not shown), the piston rod terminating in an enlarged end collar 25 of circular cross section. At its outer, or right-hand, end the body 21 of the cushioning device carries a car coupler 26.

While the internal construction of the cushioning device is not considered part of the present invention, it will be helpful to point out that in a conventional device of the type which may be used the piston 22 includes an orifice 27 of limited cross section which interconnects bodies of fluid on both sides of the piston. Thus, when a shock is applied to the coupler 26, either in "buff" or in "draft" the fluid being forced through the orifice develops a back pressure and provides a cushioning action analogous to that obtained in an automotive shock absorber. Such devices typically include means for restoring the piston to its centered position within the cylinder after the shock has been cushioned and dissipated.

For the purpose of holding the enlarged end collar 25 of the piston rod captive with respect to the sill and hence immovable in the face of impact, a backstop 30 is provided. The backstop has an inner, or left-hand, end wall 31 which extends perpendicularly to the sill axis 23 and an outer end wall 32 which is spaced parallel to it. The end walls are joined by side walls 33, 34 and by a top wall 35, the walls, together, forming a rigid and integrated unit defining a central chamber 36. The bottom of the backstop is open. The backstop may be formed of cast steel with the inner wall 31 being reinforced by integral ribs 37. The backstop is preferably anchored in its position within the sill by welding it to the walls of the sill as indicated at 38.

Figure 4:
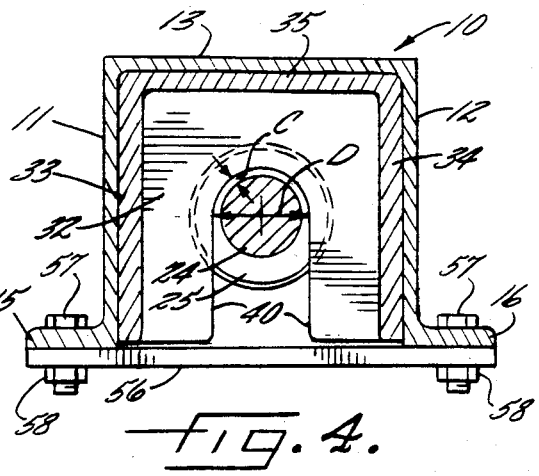

In carrying out the invention the inner and outer end walls are axially spaced from one another by a distance S, which slightly exceeds the length of the collar 25, to provide loose but axially captive accommodation of the collar thereby to anchor the piston rod. Moreover, the outer end wall 32 has an arch-shaped clearance opening 40 centered therein (FIG. 4), having a width, or diametrical, dimension D establishing a radial clearance C which provides loose captive accommodation for the piston rod 24.

Figure 3:
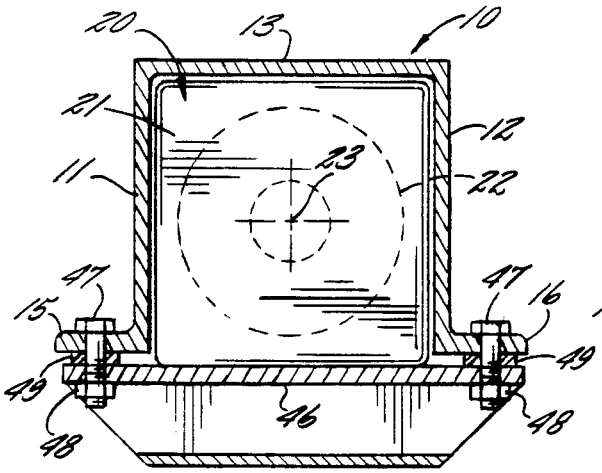
FIGS. 3, 4 and 5 show transverse sections taken along correspondingly designated section lines in FIG. 2.

To support the body of the cushioning device in its slidable operating position, the usual bridging or retaining plate 46 is used, secured at its edges (FIG. 3) to the sill flanges by a set of machine screws 47 having nuts 48.

In accordance with the present invention a thin locator plate is provided in the chamber 36 of the backstop having a circular opening for snug accommodation of the collar on the piston and having outer dimensions which correspond to the dimensions of the chamber 36. By the word "correspond" is simply meant that the dimensions of the plate are smaller than the dimensions of the chamber to a degree which permits free insertion of the plate edgewise into the chamber. The plate has secured to its lower edge a bridge member which spans the walls of the sill, and means are provided for securing the ends of the bridge member to the walls of the sill for maintaining the plate in transaxial position in the chamber with the circular opening in the plate precisely centered on the sill axis. As a result, when a buff impact occurs the piston rod engages the inner wall of the backstop in a position precisely aligned with the sill axis where it is frictionally maintained during buildup of compressive reaction force in the cushioning device.

Figure 5:
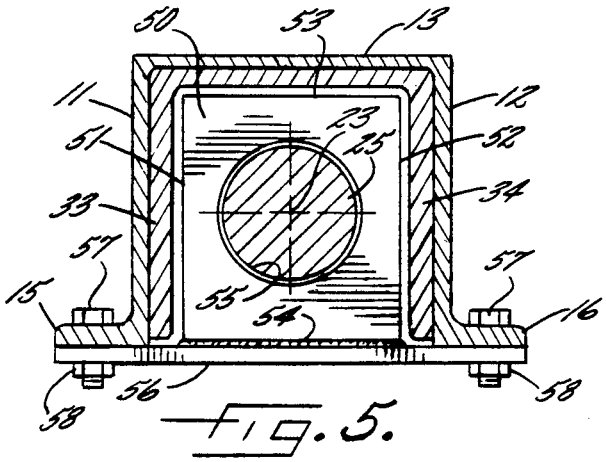

Thus, referring particularly to FIGS. 1, 2 and 5, there is shown a thin metal plate 50 having side edges 51, 52, an upper edge 53 and a lower edge 54. Formed in the plate is a circular opening 55 which is precisely centered with respect to the sill axis 23 and which is dimensioned to rather snugly encircle, and embrace, the collar 25 at the end of the piston rod. Mounted along the lower edge of the plate 50 is a bridge member 56 which spans the walls 11, 12 of the sill and which is seated at its ends on the under surfaces of the flanges 15, 16. The bridge member 56 is disengageably secured to the flanges by threaded fastening elements, preferably machine screws 57 which penetrate aligned openings in the members and which are provided with nuts 58.

In installing the elements of the combination described, it will be understood that the screws 47, 57 and their associated bridging member 46, 56 are initially disengaged. The locator plate 50 is telescoped over the collar 25, with its bridge 56, and the cushioning device is then lifted into its nested position within the sill. As the cushioning device is lifted, the locator plate 50 is guided upwardly into the chamber 36. The retaining or bridging, plate 46 is now secured by inserting the screws 47 in their registering holes and by tightening the nuts 48 thereon. Spacers 49 of predetermined thickness (FIG. 3) may be used to ensure that the body of the cushioning device has sliding clearance in the sill. Next the screws 57 which hold the bridging member 56 are inserted into position and the nuts 58 tightened thereon. The tightening of the nuts 58, accompanied by seating of the bridging plate 56 in a precise position ensures that the opening 55 in the locator plate 50 is centered with respect to the sill axis 23, hence that the collar 25 is centered precisely on the sill axis.

Thus, upon application of a "buff" impact to the cushioning device the reaction force developed in the cushioning device moves the collar 25 into a seated position on the inner wall 31 of the backstop in a position in which the piston rod 24 is precisely centered on the sill axis. After the initial endwise clearance between the end collar 25 and the inner wall 31 is taken up, there is a buildup of compressive reaction force between them which is purely axial and which does not create any side or bending forces as the piston rod 24 is telescoped into the body 21. In short, no unbalanced forces are developed in the piston rod which would tend to break the rod or which would tend to strain or damage the seals between the rod and the body of the cushioning device.

It is found that a centered initial contact between the end of the piston rod and the inner wall 31 is highly critical in the practice of the invention since, once contact takes place, the relative position of the piston rod and inner wall 31, that is, the centered position of the piston rod with respect to the wall, remains constant due to the friction between them, and no relative lateral slippage can occur in spite of the buildup of reaction forces to extremely high peak values.

Figure 6:
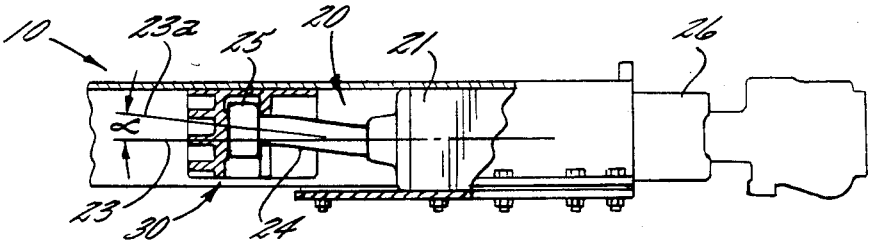
FIG. 6 is a diagram, at greatly reduced scale, and exaggerated for clarity, illustrating the position of the piston rod in a conventional installation prior to impact.
Figure 7:
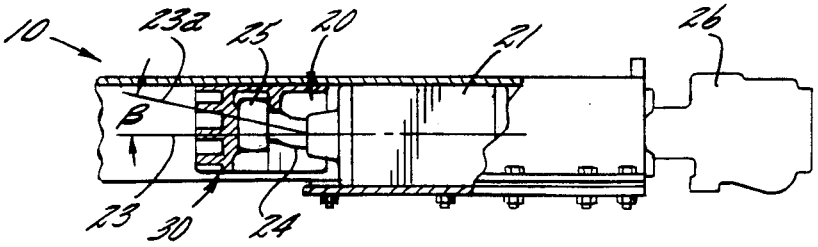
FIG. 7 is a view similar to FIG. 6 but showing the condition of the piston rod following impact and illustrating the multiplication of cocking angle.

The above is to be contrasted with what is understood to occur in a more conventional system lacking the locator plate 50 and as illustrated in FIGS. 6 and 7. My observations show that in a conventional installation the end of the piston rod, prior to impact, is not precisely centered with the sill axis 23. The reason for this may be that there is sufficient looseness between the body of the cushioning device and the sill so that the body of the cushioning device is slightly cocked "off-axis" in one direction or another. Such cocking, where in the vertical plane, may, for example, come about as a result of the large overhanging weight of the car coupler 26. In any event the axis of the piston rod, indicated at 23*a* in FIG. 6, may depart slightly from the sill axis by a shallow angle $\alpha$. Thus, when a buff impact occurs the collar 25 at the end of the piston rod will initially engage the inner wall 31 in a slightly off-center position. As the cushioning device is compressed, that is, as the piston rod telescopes into the body of the device, there will a tendency of the piston rod to shift into alignment with the sill axis 23. However, because of the large amount of friction developed at the engaged surfaces, the end of the piston rod cannot move laterally, in the present case downwardly, into alignment. On the contrary, as the piston rod telescopes into the body 21, shortening its effective length, the angle of cocking must progressively increase to a much larger value $\beta$ resulting in a progressively high degree of bending, or unbalanced, force in the piston rod, a force which, in the event of a serious buff impact, may exceed the force for which the unit has been designed, resulting in catastrophic breakage of the piston rod. Moreover, the high degree of unbalanced force produces a bending moment which must be resisted by the seals interposed between the body of the cushioning device and the rod, in time resulting in premature failure, and hence leakage, of the seals. Thus, even though the piston rod may be stressed below the breaking point, the repeated application to the seal of unbalanced force causes even a high quality seal to be worn and degraded so that the leakage, with continued usage, increases to the extent that replacement is necessary. Slight leakage may be particularly troublesome where the cushioning device is of the "gas-returned" type in which highly compressed gas is employed, for piston-return purposes, in lieu of steel springs.

Self-centering by means of the locator plate 50 also occurs in "draft" impact, that is, where an outward thrust is applied to the car coupler. The plate ensures that the collar 25 at the end of the piston rod will strike the outer wall 32 in a position precisely aligned with the sill axis, but the benefit of the invention in the draft mode is not as pronounced as in the buff mode.

While it is preferred to use the disclosed shape of opening 55 in the plate 50, it will be understood that the term "circular" as used herein includes any opening in which the boundary portions thereof which perform a 360° centering function with respect to the collar 25 lie in a circular locus.

It will be apparent that the construction described above amply fulfills the objects of the invention. The benefits of long life and freedom from catastrophic failure do not require resort to an expensive or non-standard construction. It is one of the benefits of the invention that it may employ a conventional cushioning device operating in conjunction with a conventional type of backstop with both being mounted in a conventional design of sill. The benefit is achieved by including, in such combination, a locator plate 50 which is easily and cheaply manufactured, costing but a few cents in quantity production, and which is easily installed and removed simply by tightening or loosening a pair of mounting screws. The locator plate may be of thin gauge metal since it serves merely to hold the collar at the end of the piston rod in a laterally-centerally position with light force, and the plate is not subject to stress as a result of impact regardless of how severe the impact may be.

While the invention is applicable to new construction to one of the features of the invention, it is not limited thereto and the locator plate may be applied, on a retrofyt basis, to bring its benefit to the legion of freight cars already in service.

We claim:

1. A backstop assembly for use with a cushioning device in the sill of a railway car, the sill having a top wall and parallel side walls, the cushioning device having a body slidable endwise in the sill carrying a car coupler at its outer end and having a piston contained therein centered on the sill axis and with a piston rod projecting from its inner end, the piston rod terminating in an enlarged end collar of circular cross section, the backstop assembly comprising, in combination, a backstop of a rectangular box shape fitted in the sill in seated relation and rigidly secured thereto, the backstop having a transaxial inner end wall for axially abutting engagement with the collar on the piston rod and an outer end wall arranged parallel thereto to define a central chamber, the backstop in addition having side walls adjacent the side walls of the sill, the end walls and side walls of the backstop forming a rigid and integrated unit and the end walls being axially spaced to provide loose but axially captive accommodation of the collar on the piston rod, the outer end wall having an arch-shaped clearance opening centered therein providing loose captive accommodation of the piston rod, the backstop being open at the bottom for transaxial insertion of the rod and its collar upwardly of the sill into captive position in the backstop, a locator plate fixedly mounted within said chamber intermediate said outer and inner end walls, said locator plate having a relatively thin cross sectional thickness as compared to said outer and inner end walls and being formed with a circular opening at the center for snug accommodation of the collar and having outer dimensions which correspond to the dimensions of the chamber, the plate having secured to its lower edge a bridge member spanning the walls of the sill, and means for securing the ends of the bridge member to the walls of the sill for maintaining the plate in transaxial position in the chamber with the circular opening precisely centered on the sill axis so that upon buff impact the piston rod engages the inner wall of the backstop in a position precisely aligned with the sill axis and which is frictionally maintained during buildup of compressive reaction force in the cushioning device.

2. The combination as claimed in claim 1 in which the sill has outwardly turned flanges extending longitudinally along the lower edges of its respective side walls and in which the bridge member is seated at its ends on the flanges, being disengageably secured thereto by threaded fastening elements.

* * * * *